US006615717B1

(12) United States Patent
Perdu

(10) Patent No.: US 6,615,717 B1
(45) Date of Patent: Sep. 9, 2003

(54) SYMMETRICAL PARALLEL DUPLEX PAPER PATH DEVICE

(75) Inventor: Patrick Perdu, Puntarenas (CR)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/063,111

(22) Filed: Mar. 21, 2002

Related U.S. Application Data

(60) Provisional application No. 60/299,014, filed on Jun. 18, 2001.

(51) Int. Cl.[7] ..... B41F 13/02

(52) U.S. Cl. ..... 101/223; 101/180; 101/190; 101/230; 101/257; 101/490

(58) Field of Search ..... 101/179, 180, 101/190, 222, 223, 230, 257, 490

(56) References Cited

U.S. PATENT DOCUMENTS 1,173,278 A * 2/1916 Kellogg ..... 270/6
1,735,730 A * 11/1929 Cox ..... 493/322
3,426,680 A * 2/1969 Kaufmann ..... 101/181
3,518,940 A * 7/1970 Stroud et al. ..... 101/223
3,548,783 A 12/1970 Knapp
3,744,693 A * 7/1973 Greiner ..... 242/615.12
3,906,855 A * 9/1975 Laursen ..... 101/223
4,610,198 A * 9/1986 Raymond ..... 101/223
5,467,179 A 11/1995 Boeck et al.
6,120,142 A * 9/2000 Eltgen et al. ..... 347/104
6,125,751 A * 10/2000 Korem ..... 101/180

* cited by examiner

*Primary Examiner*—Daniel J. Colilla
*Assistant Examiner*—Jill E Culler
(74) *Attorney, Agent, or Firm*—Oliff & Berridge, PLC

(57) ABSTRACT

A parallel duplex paper path device is provided for feeding a recording medium along a feed direction from a first printing device to a second printing device, which are arranged in parallel. The paper path device comprises at least two turning stations that are each assigned to one of the first or second printer. The turning stations are configured symmetrically to allow for reversing the feed direction and to allow for a device which can be assembled using standardized sub-assemblies.

27 Claims, 7 Drawing Sheets

SYMMETRICAL PARALLEL DUPLEX PAPER PATH DEVICE

Cross Reference to U.S. patent application Ser. No. 60/299,014 filed Jun. 18, 2001, entitled "System for Transfer and Inversion of a Continuous Web Substrate Between Printing and Other Devices."

BACKGROUND OF THE INVENTION

1. Field of Invention

The invention generally relates to devices for transporting a recording medium from one processing step to a subsequent processing step, and more particularly to a device for conveying paper between two printers, which are arranged in parallel.

Description of Related Art

It is well known to operate two printers in tandem mode, if both sides of a paper are to be printed. In such a tandem configuration, the paper is output from a first printer, the "upstream" printer, and fed into the second printer, the "downstream" printer. For duplex printing, the paper is turned before being fed into the downstream printer. Usually, the turning is done by a duplex paper path device which is located in the paper path between the two printers.

Depending on the arrangement of the printers, the tandem configuration may be an "L"-shaped configuration, where the two printers are oriented perpendicular to each other, an "inline" configuration, where the two printers are arranged one behind the other, and a "parallel" configuration, where the two printers are located side-by-side substantially parallel to each other. Usually, the duplex paper path devices are adapted to be used exclusively for one of these arrangements. For example, a paper path device for an L-shaped printer configuration cannot be used for an inline or a parallel configuration.

U.S. Pat. No. 3,548,783 discloses a duplex paper path device for two printers in an L-shaped configuration. With this device, the paper is driven through a guide means in the form of a hollow, curved guide track. In the guide means, the direction of movement of the paper is changed and the paper is inverted while moving from the upstream printer to the downstream printer. Although the device disclosed in U.S. Pat. No. 3,548,783 allows for a reversal of the direction of movement of the paper, it does not allow for any additional flexibility, such as bypassing one of the two printers or operating in simplex mode, i.e. without turning the paper.

U.S. Pat. No. 5,457,179 discloses a turnover device for continuous feed printers in an inline configuration, where the upstream printer is located in front of the downstream printer. Thus, with the device known from U.S. Pat. No. 5,457,179 the feed direction of the paper upon entry in the turnover device is the same as upon leaving the turnover device. Due to the inline arrangement of the printers, it is difficult to bypass one of the printers, if this printer should not be not available because of e.g. maintenance or repair. Thus, the flexibility of the configuration disclosed in U.S. Pat. No. 5,457,179 is not sufficient for today's requirements.

To increase flexibility, the parallel configuration of the printers may be used. Such an arrangement allows operation of the two printers independently in simplex mode. In addition, both printers can be coupled in tandem mode to perform duplex printing. Furthermore, it is comparatively easy to bypass one of the printers.

For a parallel printer configuration, parallel duplex paper path devices are known that comprise two turning sections, which cooperate to change the feed direction and to turn the paper.

With the known parallel duplex paper path devices, however, several problems exist. For example, a rearrangement of the paper path, e.g. an inversion of the feed direction requires major efforts in rearranging and adjusting the components of the paper path device. Thus, the known parallel paper path devices do not allow much flexibility in altering the series of processing steps. Further, at high paper velocities, the paper tends to build up oscillations and its position tends to drift laterally, so that a paper break is likely to occur. Finally, use of heavy paper results also in a high likelihood of a paper break with the known devices.

Given the problems of the existing parallel duplex paper path technologies, there is a need to provide a device which allows for an easy rearrangement of the paper path and thus leads to greater flexibility.

Further, there is need to provide a parallel paper path device which is capable of processing paper at high velocities without increasing the risk of paper breaks. Such a device would allow for a more efficient processing of paper at lower overhead costs.

Finally, there is need to provide a parallel paper path device which is capable of being operated with a wide variety of paper types.

SUMMARY OF THE INVENTION

Various exemplary embodiments of this invention separately provide a parallel duplex paper path device configured for feeding a recording medium along a feed direction from a first printing device to a second printing device, the second printing device being arranged substantially in parallel to the first printing device, the paper path device comprising at least two turning stations, the turning stations cooperating to turn the recording medium and to change the feed direction of the recording medium, wherein the turning stations are configured symmetrically.

BRIEF DESCRIPTION OF THE DRAWINGS

The accompanying drawings are incorporated into and form a part of the specification to illustrate various exemplary embodiments of the present invention. These drawings, together with the description, serve to explain the principles of the various exemplary embodiments of the invention. The drawings are only for the purpose of illustrating alternative exemplary embodiments of how the invention can be made and used and are not to be construed as limiting the invention to only the illustrated and described exemplary embodiments. Further features and advantages will become apparent from the following description of the various exemplary embodiments of the invention as illustrated in the accompanying drawings, wherein.

DETAILED DESCRIPTION OF PREFERRED EMBODIMENTS

The configuration of an exemplary embodiment of the invention is explained with reference to FIGS. 1 and 2. Then, exemplary modes of operation of the exemplary embodiment shown in FIG. 1 are explained with reference to FIGS. 3 to 7.

Throughout the description, the term "paper path device" is synonymously used for "symmetrical duplex parallel paper path device". The term "feed direction" always refers to the local direction of movement of the recording medium, and the term "change of feed direction" refers to a change of the local direction of movement as seen in a stationary frame of reference.

Figure 1:
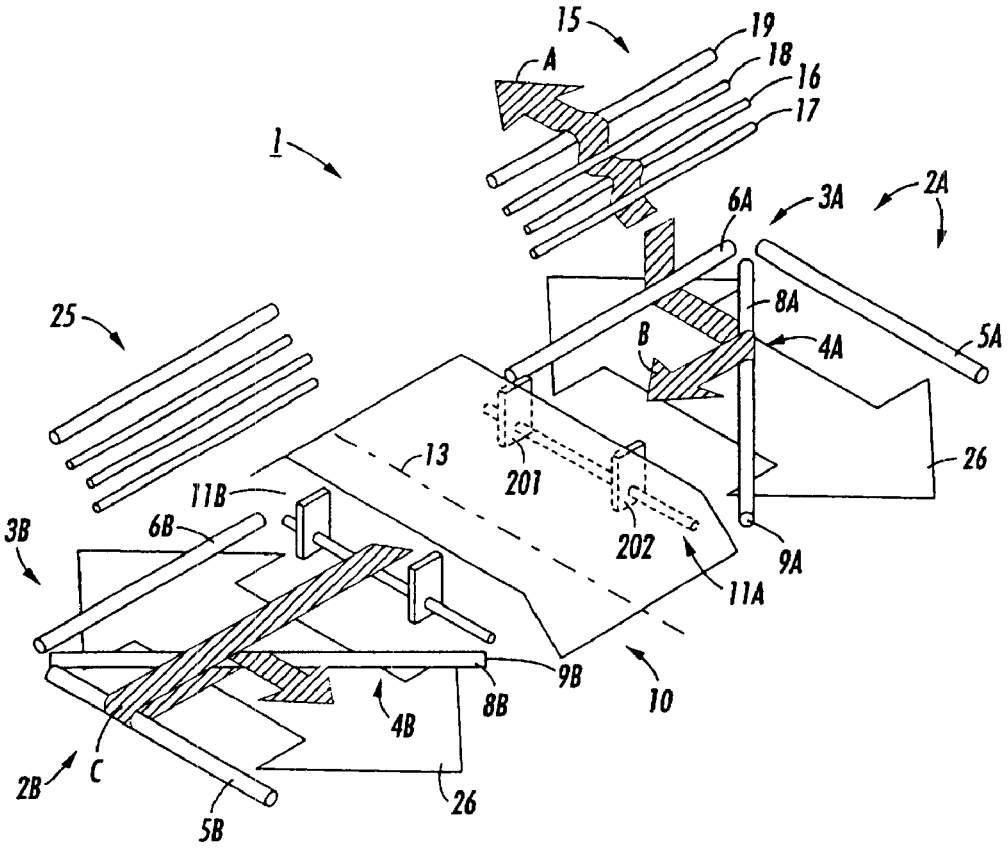
FIG. 1 shows an exemplary parallel duplex paper path device according to the invention.

FIG. 1 shows a symmetrical parallel duplex paper path device 1 comprising two turning sections 2A, 2B which are each assigned to one printer (not shown). In FIG. 1, the right-hand turning section 2A is assigned to and arranged close to an upstream printer ("upstream" turning section 2A), while the left-hand turning section 2B is assigned to and arranged close to a downstream printer ("downstream" turning section 2B). Both printers are arranged in a parallel configuration and, according to FIG. 1, operated in tandem mode.

Further, in FIG. 1, the path of a recording medium, such as a continuous web of paper, through the paper path device 1 is indicated by arrows A, B, C. It is understood that, although there are shown three separate arrows A, B, C, the paper path is in fact continuous and is not interrupted. The side of the recording medium which has been printed by the upstream printer, is indicated by the cross-hatched side of arrows A, B, C.

First, the arrangement of the components of the paper path device 1 is described.

Each turning section 2A, 2B comprises a deflection unit 3A, 3B and a turning unit 4A, 4B.

The deflection units 3A, 3B serve to change the feed direction of the recording medium and to guide the recording medium to the respective turning unit 4A, 4B.

Each deflection unit 3A, 3B comprises preferably two deflection bars 5A, 6A or 5B, 6B, respectively, of circular cross-section. Each deflection bar is extended perpendicular to the feed direction. For certain applications, there may be provided more than two deflection bars in a turning section.

Each deflection bar 5A, 5B, 6A, 6B may be supported in a free-wheeling manner in a stationary frame (not shown). Further, each deflection bar may be covered with a resilient material, which elastically decreases the effective diameter of the corresponding deflection bar if the tension in the recording medium increases above a predetermined threshold level. Thus, small variations in the tension of the recording medium may be absorbed by the elasticity of the cover. This leads to an increased damping of oscillations of the recording medium and to a smoother transport. Preferably, the resilient material is conductive and grounded to avoid build-up of static electricity. Alternatively, the deflection bars 5A, 5B, 6A, 6B may be fabricated from polished steel.

The deflection bars of each turning section are arranged substantially perpendicular to each other. The axes of the deflection bars of one turning section are approximately located on the same plane. In another configuration, the axes of all deflection bars 5A, 6A, 5B, 6B may also be located on a single plane.

Each turning unit 4A, 4B comprises an angled bar 8A, 8B, which is arranged on or approximately on the bisecting line of the angle enclosed between deflection bars 5A and 6A or between deflection bars 5B and 6B.

Looking from above, each turning section 2A, 2B has a rectangular, preferably a square, ground plan. At the edge of each square facing away from the printers, deflection bars 6A and 6B are located. At the outside edges of each square, i.e. the edges facing away from the turning sections 2A, 2B, deflection bars 5A and 5B are located.

The angled bars 8A, 8B of the two turning sections 2A, 2B are arranged in a V-like configuration, in which the axes 9A, 9B of the angled bars 8A, 8B converge towards the printers.

The location of the axes 9A, 9B of the angled bars 8A, 8B may be offset vertically by a predetermined distance relative to the respective plane formed by the axes of deflection bars 5A and 6A or 5B and 6B.

Each angled bar 8A, 8B may be supported in a stationary position on a frame (not shown) of the paper path device 1. In this case, the stationary angled bar 8A, 8B is equipped with a means to generate an air cushion between the bar surface and the recording medium. The means for generating an air cushion may include any apparatus capable of pressing air or any other suitable fluid into the region between the surface of angled bar 8A, 8B and the recording medium, such as a high-pressure air reservoir, a pump, or a blower. The means further includes a plurality of holes (not shown) in the surface of angled bar 8A, 8B. Preferably, the holes are arranged in an area of the surface, where the contact pressure between the angled bar 8A, 8B and the recording medium is large. Through these holes, the air is directed to form the air cushion. The supply of air may be further facilitated if the angled bar 8A, 8B has a substantially hollow core and if the air is supplied to the holes through the hollow core.

The two turning sections 2A, 2B may be separated, as shown in FIG. 1, by an intermediate section 10 bridging the distance between the two turning sections 2A, 2B. The intermediate section 10 may be configured, as shown in the embodiment of FIG. 1, as a tunnel section. Further, there is at least one lateral guidance 11A, 11B arranged between the turning sections 2A, 2B. In the embodiment of FIG. 1 there is provided one lateral guidance between each turning section 2A, 2B and the intermediate section 10.

As can be seen from FIG. 1, the turning sections 2A, 2B and the overall configuration of the parallel duplex paper path device 1 is symmetrical about a center axis 13. In particular, the two turning sections 2A, 2B may be identically configured and thus may be easily interchangeable with each other. Due to the symmetry, the sub-assemblies on both sides of the paper path device 1 are identical which allows use and manufacture of standardized sub-assemblies for paper path device 1.

To avoid build-up of static electricity in the paper path device 1 and on the recording medium, all elements that may contact the recording medium, are made of conductive material and are grounded. In particular, the surfaces of the deflection bars 5A, 5B, 6A, 6B, of the angled bars 8A, 8B, of the tunnel section 10, and of the lateral guidances 11A, 11B are conductive and grounded.

Next, the operation of the symmetrical parallel duplex paper path device is explained with reference to FIG. 1.

The recording medium, such as paper in continuous web form or a series of paper sheets, exits the upstream printer at an exit location in the feed direction indicated by arrow A. The first printer has printed information on one side of the recording medium, e.g., as shown in FIG. 1, the upward facing side of the recording medium.

After exiting the upstream printer, the recording medium may enter a first feeder 15, which may be located in a paper hopper area of the first printer. The feeder 15 may be equipped with a movable tensioning bar 16 and two driven bars 17, 18. The tensioning bar is biased against the tension of the recording medium and balances variations in the tension of the recording medium by a movement perpendicular to the plane of the recording medium. An exit bar 19 of the feeder of larger diameter than the bars 16, 17, 18 is supported in a free-wheeling manner on a frame (not-shown). The exit bar 19 may be made from polished steel, or may be covered with a resilient conductive material, or may be surrounded by an air cushion as described above.

In an alternative embodiment, the feeder 15 may be omitted. In this case, the recording medium is directly fed from the printer to the paper path device 1. Or, only exit bar 19 may be used to guide the paper from the upstream printer to the paper path device 1.

The recording medium is input in the paper path device 1 from above at the side opposite to the printers. It is understood that the recording medium may also be fed into the paper path device 1 at the side adjacent to the printers.

The feed direction B of the recording medium upon entry into the paper path device 1 is first deflected by the deflection bar 6A at an angle of approximately 90 degrees. In alternative embodiments, especially if no feeder 15 or if different printers are used, the feed direction may be changed by angles other than 90 degrees by the deflection bar 6A. To avoid damages to the printed surface, the recording medium is wound around deflection bar 6A in such a manner that the printed side of the recording medium faces away from the deflection bar 6A.

The recording medium is then guided in a substantially horizontal direction to the lower half of angled bar 8A.

The recording medium is wound from below around angled bar 8A in the following manner: The point of first contact between the recording medium and the angled bar 8A is located at the underside of the angled bar 8A. The recording medium is then wound around the part of the surface of angled bar 8A which faces the first printer, and leaves the surface of the angled bar 8A from the top portion. As stated above, there is an air cushion between the surface of angled bar 8A and the recording medium to reduce friction, and the printed side of the recording medium faces away from the surface of angled bar 8A.

In the embodiment of FIG. 1, it is shown that angled bar 8A extends in an oblique angle of approximately 45 degrees relative to the feed direction. Thus, the change in feed direction introduced by angled bar 8A is approximately 90 degrees. In contrast to the change of the feed direction introduced by the deflection bar 6A, however, the feed directions shortly upstream and shortly downstream of angled bar 8A are parallel, i.e. lie in parallel planes approximately offset by the diameter of the angled bar 8A.

After leaving the angled bar 8A, the feed direction C is approximately perpendicular to the center axis 13 of the paper path device 1.

To stabilize the paper path and to avoid lateral oscillations or a lateral drift of the recording medium during transport, lateral guidance bar 11A is arranged downstream of the turning section 2A. Lateral guidance bar 11A is configured as a bar which extends in a direction perpendicular to the local feed direction, and is provided with two guiding elements 201, 202 in the form of plate-like structures extending in the feed direction. The guiding elements, 201 and 202 are positioned near the edges of the recording medium and form a mechanical stop against which the edges of the recording medium run if the lateral movement of the recording medium exceeds a predetermined amount. To adjust the amount of allowable side motion depending on process parameters such as paper speed, paper weight, and/or the type of printing devices, the guiding elements 201, 202 are movably supported in a direction perpendicular to the feed direction. There may also be provided some means for locking the position of guiding elements 201, 202, once they have been moved into their position. Instead or in addition to the plate-like structures, rollers or bars extending substantially in the vertical direction may also be used. It is important that the edges of the recording medium preferably not be damaged by contact with the lateral guiding elements 201, 202. Damages to the edges of the recording medium would otherwise very likely lead to a paper break.

Upstream of the lateral guidance there is at least one intermediate section 10. In the embodiment shown in FIG. 1, the intermediate section 10 is configured as a tunnel section. Alternatively, a transport plate (not shown) may be used, on which the paper is conveyed while being exposed. Intermediate section 10 is depicted in greater detail in FIG. 2.

Figure 2:
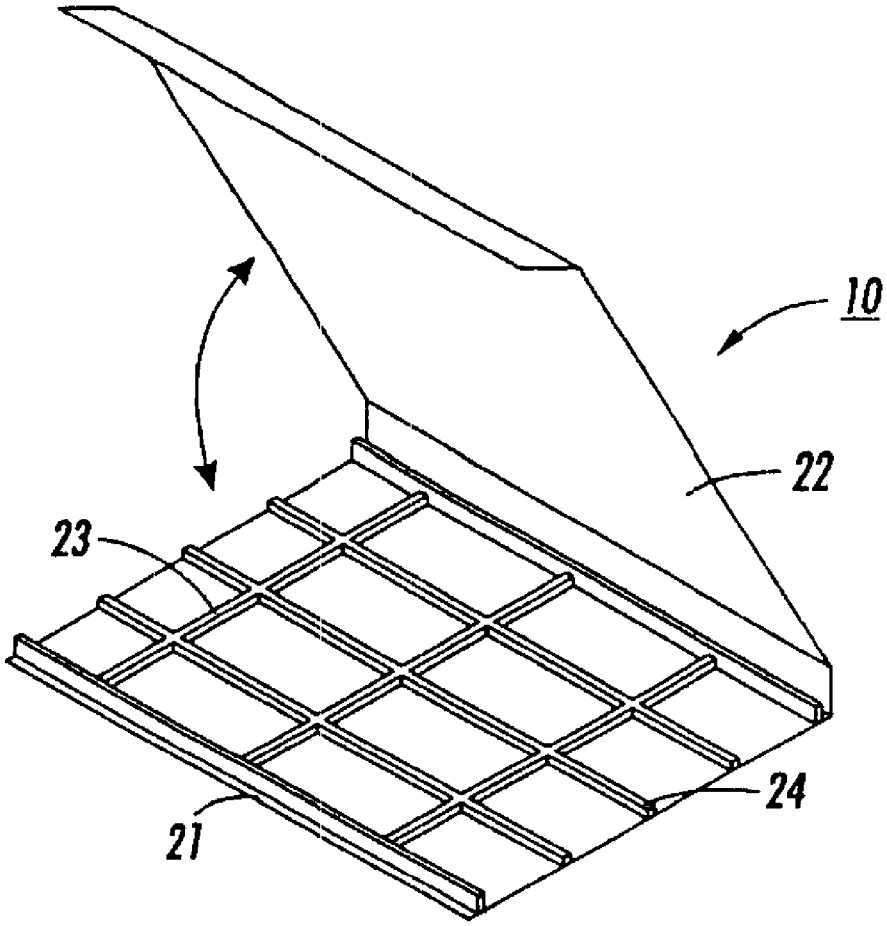
FIG. 2 shows a component of the exemplary paper path device of FIG. 1.

Turning to FIG. 2, the intermediate section 10 comprises a base part 21 and a cover 22 configured to be opened in a pivotal fashion. There may be hinges for pivotally supporting the cover on the base part. In the closed state of the intermediate section 10, there is a substantially planar gap formed between the base part 21 and the cover 22. Through this gap, the recording medium is guided. Preferably, the recording medium will not touch the intermediate section 10 on its passage through the tunnel to avoid abrasion, increased friction, and thus paper breaks. As shown in FIG. 2, there may be provided small-diameter roller bars 23 or rollers with a low angular inertia, such as hollow rollers, within the intermediate section 10. Preferably, the roller bars 23 are arranged in areas where the recording medium may come in contact with the intermediate section 10 during operation, and extend in a direction perpendicular to the feed direction. Further, there are reinforcing ribs 24 provided in the base part 21 to reinforce the base part 21.

Returning to FIG. 1, downstream of the intermediate section 10, a lateral guidance bar 11B is located. This lateral guidance bar 11B is of the same configuration as upstream lateral guidance bar 11A. Lateral guidance bar 11B serves also to adjust and stabilize the position of the recording medium in a direction perpendicular to the feed direction C. As both lateral guidance bars 11A and 11B are substantially identical, reference is made to the above description of the upstream lateral guidance bar 11A.

At the downstream end of the paper path within the parallel paper path device 1, there is downstream turning section 2B, which is substantially identical to the upstream turning section 2A. However, the recording medium is fed differently through the downstream turning section 2B as compared to the upstream turning section 2A.

After entering the downstream turning section 2B, the recording medium first passes over angled bar 8B and is directly fed to deflection bar 5B extending substantially perpendicular to the feed direction. The feed direction is changed by deflection bar 5B by 180 degrees, i.e. the feed direction shortly downstream of deflection bar 5B is reversed relative to the feed direction shortly upstream of deflection bar 5B and is offset in the vertical direction by approximately the diameter of deflection bar 5B. The first point of contact between the recording medium and the deflection bar 5B is at the top part of deflection bar 5B.

After leaving the deflection bar 5B, the recording medium is fed from below to angled bar 8B, which extends at an oblique angle, such as around 45 degrees, relative to the feed direction C. The recording medium is wound around the part of the surface of angled bar 8B which faces away from the printers. It is to be noted, that the imprinted surface of the recording medium faces away from both the angled bar 8B and the deflection bar 5B, so that no damage can be done to the print.

The recording medium is drawn off the top part of the angled bar 8B and fed to the downstream printer or to any other apparatus suitable for processing the printed recording medium. Upon leaving the symmetrical duplex paper path device as exemplified in the embodiment of FIG. 1, the recording medium has been turned. Thus, the downstream printer may now print information on the other side, i.e., the side not yet printed on, of the recording medium.

There may be a second feeder 25 arranged between the paper path device 1 and the downstream printer or other downstream processing devices. The second feeder 25 is substantially identical to the first feeder 15. Therefore, reference is made to the above description of the configuration and mode of operation of the first feeder 15.

Due to the symmetry of the paper path device 1, the feeding direction may be reversed without additional adjustments to the device. With reference to FIG. 1 a reversal of the feed direction implies that the upstream turning section 2A becomes the downstream turning section and the downstream turning station 2B becomes the upstream turning station. The paper path has to be changed accordingly: In case of a reversed feed direction, the recording medium enters the paper path device by being deflected by deflection bar 6B of the turning section 2B, then passing angled bar 8B, passing the lateral guidance bar 11B, the intermediate section 10, the lateral guidance bar 11A, the deflection bar 5A, and finally the angled bar 8A. The resulting paper path is thus a mirror image of the paper path shown in FIG. 1 using axis 13 as axis of reflection.

The paper path device 1 according to the invention does not need feeders located in its paper path for turning the paper and changing the feed direction. It further features a very low turn rating as compared to the prior art. This means that the sum of the contact angles of the recording medium with all of the deflection bars 5A, 5B, 6A, 6B and the angled bars 8A, 8B is very low. In the embodiment shown in FIG. 1, the turning rating of the paper path device 1 may be below 600 degrees. In particular, the turn rating may be around 570 degrees, the contact angle at the deflection bar 6A being around 90 degrees, the contact angle at each angled bar 8A, 8B being around 180 degrees, respectively, and the contact angle at deflection bar 5B being around 120 degrees. A preferred diameter for the deflection bars 5A, 5B, 6A, 6B is about 40 mm, a preferred diameter of the angled bars 8A, 8B is about 60 mm. The contact angle at the exit bar 19 is around 120 degrees.

Arrows 26 indicate alternative paper paths through the symmetrical parallel paper path device 1. Along these paper paths, the recording medium may be directly fed to other processing equipment such as stackers, cutters, binders, bursters, trimmers, inserters, folders, label-stickers, post-printers and the like.

Figure 3:
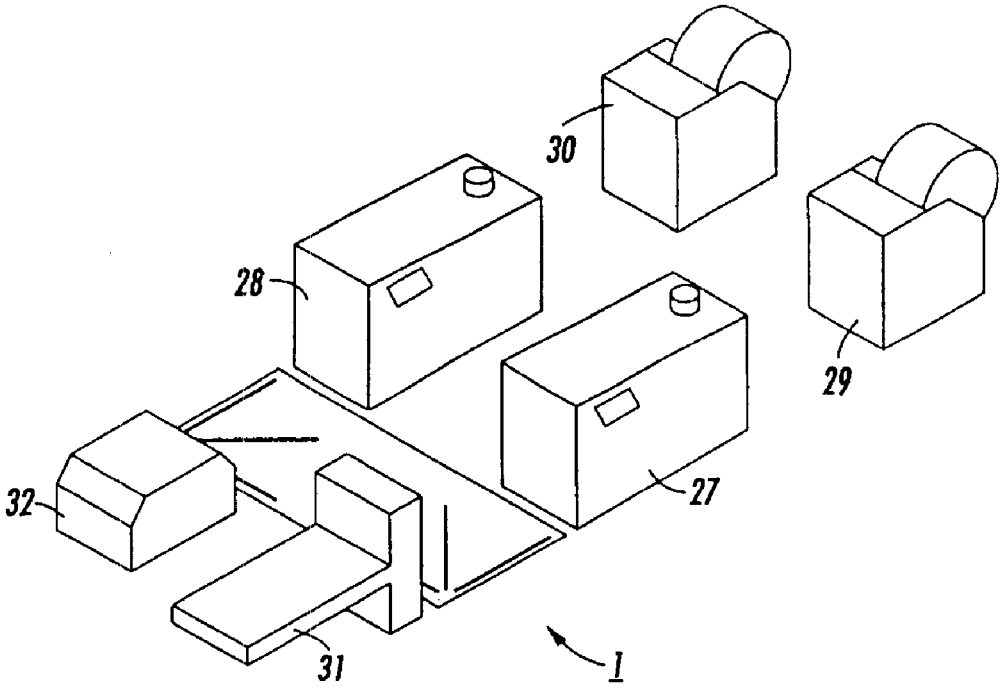
FIG. 3 shows an exemplary print room arrangement with two parallel printers together with an exemplary paper path device according to the invention and post-processing equipment.

FIG. 3 shows one example, how the symmetrical parallel duplex paper path device 1 according to the invention may be arranged in a print room. A first printer 27 and a second printer 28 are arranged in parallel. Both printers may be of the continuous-feed type.

For each printer 27, 28, there is provided an unwinder 29, 30 feeding the paper in continuous web form from paper rolls to the printers 27, 28. Further, there is post-processing equipment installed in the print room to process the printed paper, such as a folder 31 and a cutter/stacker 32. It should be noted that any other post-processing equipment may be used instead of a folder 31 or a cutter/stacker 32. The paper path device 1 is arranged between the printer 27, 28 and the post-processing equipment 31, 32.

Unwinder 29, printer 27, and folder 31 constitute a first print line, and unwinder 30, printer 28 and cutter/stacker 32 constitute a second print line parallel to the first print line.

FIGS. 4 to 8 show various modes of operation of the paper path device 1 according to the invention. In these figures, the paper path device 1 is shown only schematically.

Figure 4:
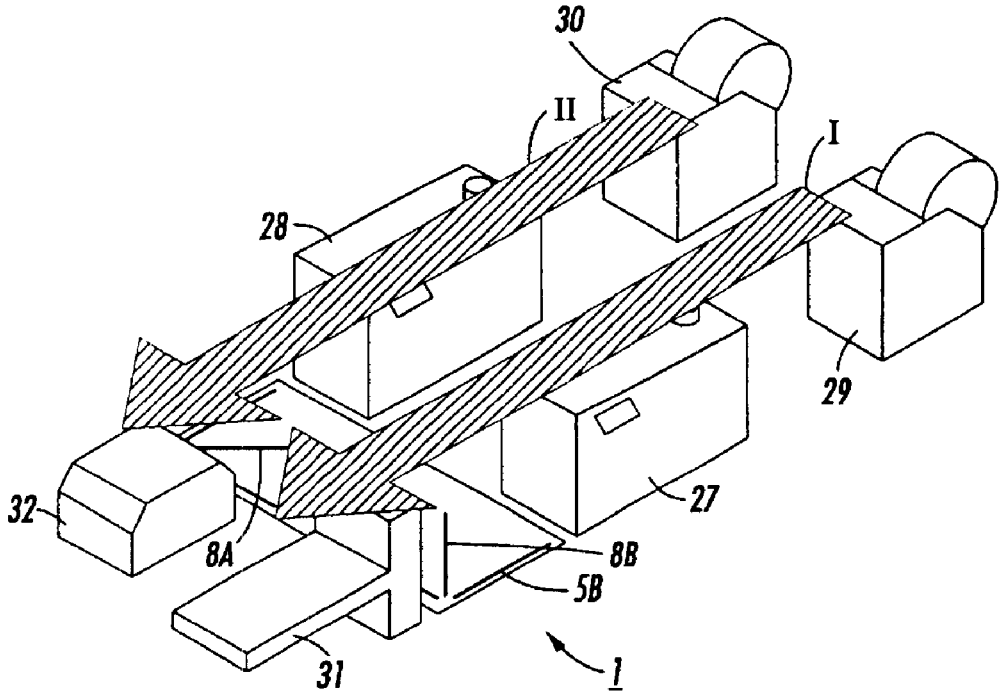
FIG. 4 shows a first exemplary mode of operation of the exemplary parallel duplex paper path device depicted in FIG. 1.

In FIG. 4, a dual simplex line with two independent, parallel print lines I and II is shown. The front line I prints to the folder 31 in simplex mode, the back line II prints to the cutter/stacker 32 in simplex mode. In the paper path device 1, the paper is fed along arrows 26 shown in FIG. 1.

Figure 5:
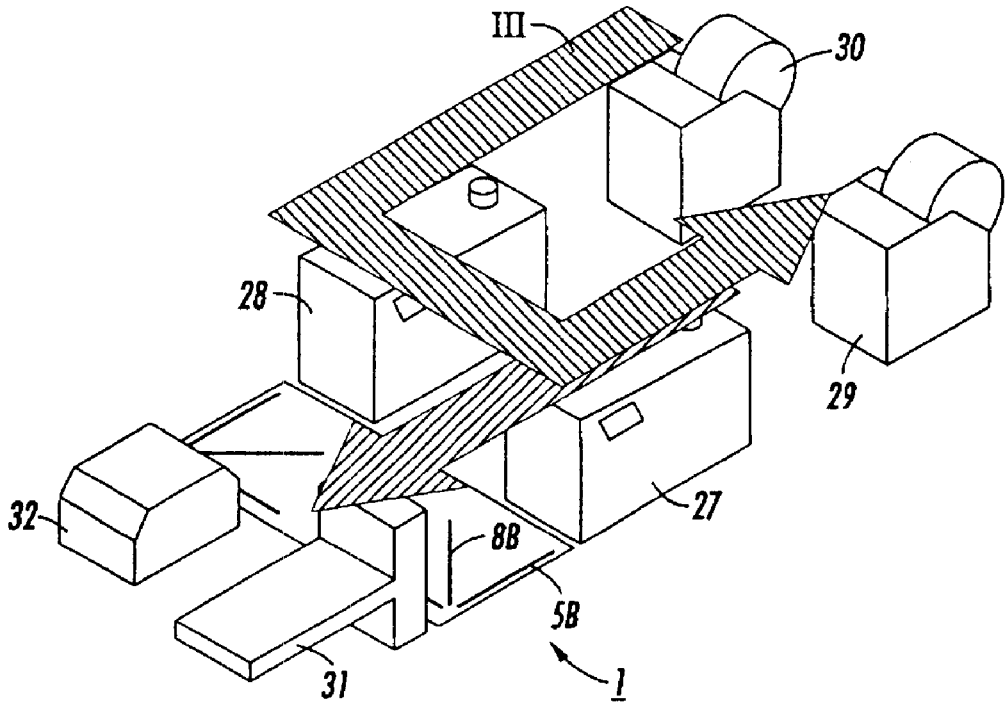
FIG. 5 shows a second exemplary mode of operation of the exemplary parallel duplex paper path device depicted in FIG. 1.
Figure 6:
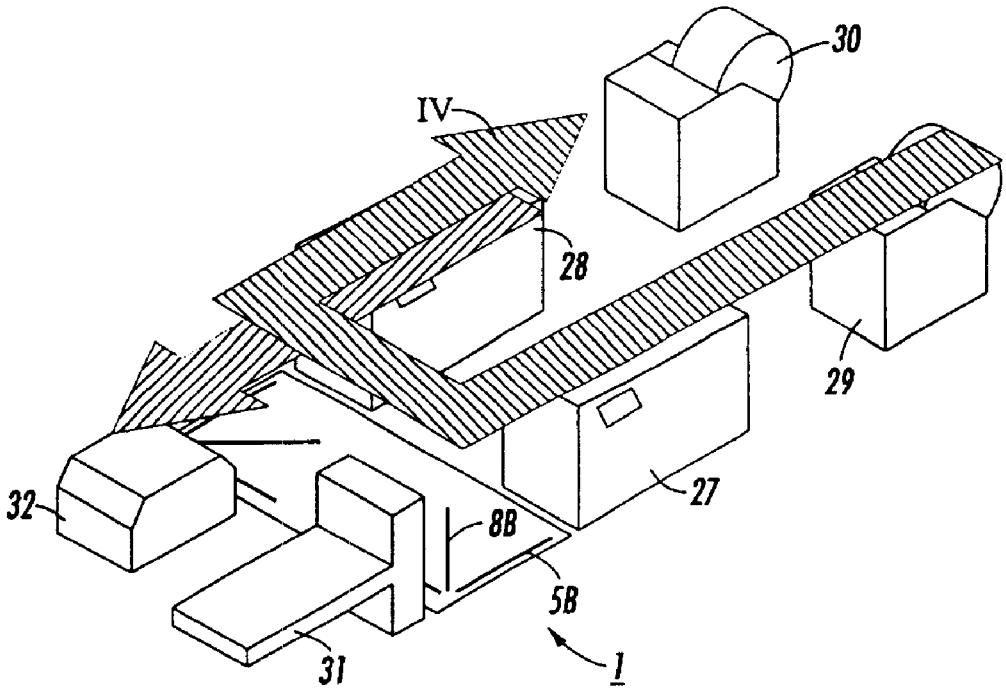
FIG. 6 shows a third exemplary mode of operation of the exemplary parallel duplex paper path device depicted in FIG. 1.

In FIGS. 5 and 6, parallel duplex printing modes are shown. In these modes, one face of the recording medium is printed by the upstream printer 27, 28, the recording medium is then fed through the paper path device 1 and turned as described in FIG. 1, and the other face of the recording medium is printed by the downstream printer 27, 28. Then, the recording medium is fed to post-processing equipment 31, 32.

FIG. 5 shows a parallel duplex printing mode, where a print line III prints to the folder 31. Thus, paper is fed from unwinder 30 to second printer 28, then via the paper path device 1 to the first printer 27 and finally to folder 31. This mode of operation corresponds to the mode of operation shown in FIG. 1.

Without any modifications to the paper path device except for unloading and newly loading of the paper, the feeding direction in the paper path device 1 may be reversed. This is shown in FIG. 6, where the print line IV prints to the cutter/stacker 32. Thus, paper is fed from unwinder 29 to the first printer 27, through the paper path device 1, to the second printer 28, and finally to the cutter/stacker 32.

Figure 7:
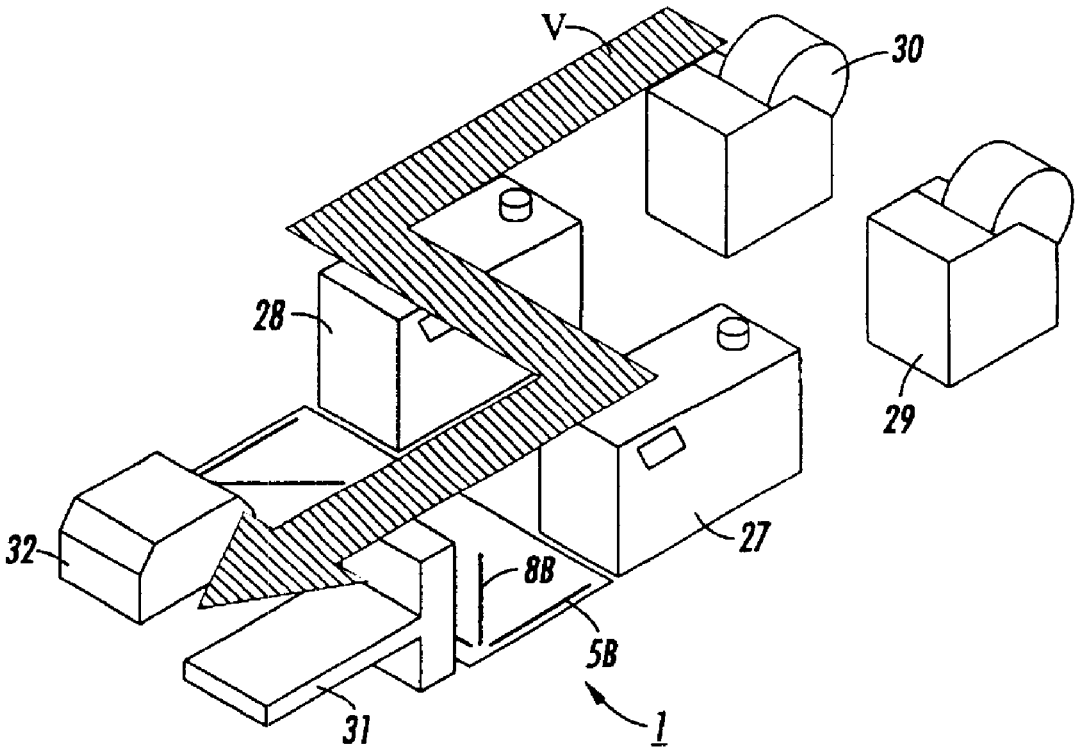
FIG. 7 shows a fourth exemplary mode of operation of the exemplary parallel duplex paper path device depicted in FIG. 1.

FIG. 7 shows a modification of the simplex line of FIG. 4. In the case where one of the printers 27, 28 is not available, the paper path device 1 may be used to redirect the paper along paper path V to the post-processing device and thus to bypass the printer, which is not available. If, for example, printer 27 is not be available, but the recording medium has to be processed by the folder 31, paper is fed from unwinder 30 to the second printer 28 and is then redirected by the paper path device 1 to the folder 31. In the simplex mode, the recording medium is not turned by the paper path device, only the feed direction or the paper path is changed. For this mode, only the position of one or both of the angled bars 8A, 8B has to be adjusted for optimum performance.

The invention has been made in view of the above and provides a duplex parallel paper path device 1 configured for conveying a recording medium along a feed direction from a first printing device to a second printing device, the second printing device being parallel to the first printing device. The duplex parallel paper path device 1 comprises at least two turning sections 2A, 2B, which cooperate to turn the recording medium and to change the feed direction of the recording medium.

The problems encountered in prior art devices are solved according to the invention by configuring the turning sections 2A, 2B symmetrically. By doing so, the paper path can be rearranged and the feeding direction can be reversed without time-consuming adjustment measures. Further, the symmetrical design of the turning sections 2A, 2B allows the use of standardized sub-assemblies which facilitates the manufacture of the paper path device 1 and the replacement of parts. Further, the symmetrical design of the turning sections 2A, 2B leads also to a higher stability of the recording medium during transport, i.e. less oscillations and less drift.

Further improvements in the turning section 2A, 2B allow an increase in the processing speed without increasing the risk for damages to the recording medium. In at least one advantageous exemplary embodiment, for example, the turning sections 2A, 2B may comprise free-wheeling bars 19 for guiding and deflecting the recording medium that are covered with a resilient material. With such an elastic cover, variations in the tension of the recording medium can be balanced or absorbed.

Another improvement concerns the design of angled bars 8A, 8B that may be provided in the turning sections 2A, 2B. The angled bars 8A, 8B are used to turn the recording medium. According to a further at least one advantageous exemplary embodiment, an air cushion is arranged between the surface of such an angled bar 8A, 8B and the recording medium. Thus, there is no direct contact between the angled bar 8A, 8B and the recording medium. The air cushion minimizes mechanical stresses in the paper and enhances the stability of the conveying process.

According to another improvement of the invention, the angled bar 8A, 8B may be arranged such that the printed surface of the paper faces away from the angled bar 8A, 8B while passing the angled bar 8A, 8B. With this configuration, damage is avoided on surfaces of the recording medium, on which information has already been stored or printed.

Further improvements of the invention, which lead to a more stable transport of the recording medium at higher feeding velocities, are concerned with providing lateral guidance bars 11A, 11B and/or an intermediate section 10 between the turning sections 2A, 2B. These measures limit lateral shifting of the recording medium in a direction perpendicular to the feed direction.

While the invention has been described with respect to preferred embodiments constructed in accordance therewith, it will be apparent to those skilled in the art that various modifications, variations and improvements of the present invention may be made in the light of the above teachings and within the purview of the appended claims without departing from the spirit and intended scope of the invention.

In addition, those areas, in which it is believed that those of ordinary skill in the art are familiar, have not been described herein in order to not unnecessarily obscure the invention described herein. Accordingly, it is to be understood that the invention is not to be limited by the specific illustrative embodiments.

What is claimed is:

1. A parallel duplex paper path device configured for feeding a recording medium along a feed direction from a first printing device to a second printing device, the second printing device being arranged substantially in parallel to the first printing device such that the first printer and the second printer are adjacent to each other in a horizontal plane and parallel in the horizontal plane, the paper path device, comprising:

at least two turning stations, each turning station cooperating to turn the recording medium and to change the feed direction, wherein the turning stations are configured symmetrically about a central axis.

2. The parallel duplex paper path device according to claim 1, wherein each turning station comprises a deflection unit with at least one deflection bar arranged substantially perpendicular to the feed direction of the recording medium.

3. The parallel duplex paper path device according to claim 2, wherein the at least one deflection bar is rotationally supported.

4. The parallel duplex paper path device according to claim 2, wherein the at least one deflection bar is covered with a resilient material.

5. The parallel duplex paper path device according to claim 2, wherein the at least one deflection bar has a polished surface.

6. The parallel duplex paper path device according to claim 1, wherein each turning station comprises a deflection unit with two deflection bars arranged substantially perpendicular to each other and wherein one of the two deflection bars has a longitudinal axis arranged substantially perpendicular to the feed direction of the recording medium.

7. The parallel duplex paper path device according to claim 6, wherein the deflection bars are lying in substantially one plane.

8. The parallel duplex paper path device according to claim 1, wherein each turning station comprises a turning unit with an angled bar arranged in an oblique angle to the feed direction of the recording medium.

9. The parallel duplex paper path device according to claim 8, wherein the oblique angle is approximately 45°.

10. The parallel duplex paper path device according to claim 8, wherein a longitudinal axis of the angled bar is offset vertically with respect to a plane of axes of two deflection bars associated with each turning station, the two deflection bars being arranged substantially perpendicular to each other and one of the two deflection bars being arranged substantially perpendicular to the feed direction of the recording medium.

11. The parallel duplex paper path device according to claim 8, wherein the angled bar is substantially stationary with respect to the printers.

12. The parallel duplex paper path device according to claim 8, wherein an air cushion is at least partially arranged between the recording medium and the angled bar.

13. The parallel duplex paper path device according to claim 8, wherein a printed side of the recording medium faces away from a surface of the angled bar while being wound around the angled bar.

14. The parallel duplex paper path device according to claim 8, wherein the angled bar is located on the bisecting line between two deflection bars.

15. The parallel duplex paper path device according to claim 1, wherein an intermediate section is arranged between the at least two turning stations, the recording medium being guided through the intermediate section.

16. The parallel duplex paper path device according to claim 15, wherein the intermediate section is a tunnel through which the recording medium travels between the at least two turning stations.

17. The parallel duplex paper path device according to claim 15, wherein the intermediate section is equipped with at least one roller bar extending substantially perpendicular to the feed direction.

18. The parallel duplex paper path device according to claim 1, wherein there is at least one lateral guidance bar for adjusting movement of the recording medium in a direction perpendicular to the feed direction, each lateral guidance bar being arranged between the at least two turning stations.

19. The parallel duplex paper path device according to claim 1, wherein the at least two turning stations are identically configured and interchangeable with each other.

20. The parallel duplex paper path device according to claim 1, wherein a sum of contact angles in the paper path device is less than 600 degrees.

21. The parallel duplex paper path device according to claim 1, wherein a sum of contact angles in the paper path device is approximately 570 degrees.

22. The parallel duplex paper path device according to claim 1, wherein the diameter of the deflection bars is about 40 mm, and the diameter of the angled bars is about 60 mm.

23. The parallel duplex paper path device according to claim 1, wherein the parallel duplex paper path device is configured symmetrically as a whole.

24. The parallel duplex paper path device according to claim 1, wherein the parallel duplex paper path device is configured for feeding the recording medium along a feed direction from the first printing device, by passing the second printing device, to a post-processing unit.

25. A method of transporting a recording medium in simplex mode comprising:

providing at least two printers joined by a parallel paper path device having at least two turning stations arranged symmetrically about a central axis, each turning station having at least one deflection bar perpendicular to a respective initial feed direction and rotationally supported, each turning station having an angled bar extending obliquely relative to the respective initial feed direction;

printing a first side of the recording medium in one of the at least two printers;

feeding the recording medium to each of the at least two turning stations over the at least one deflection bar corresponding to each of the at least two turning stations in the respective initial feed directions; and feeding the recording medium in the respective initial feed directions to exit each turning station of the parallel paper path device and enter a post processing device.

26. A method of transporting a recording medium in duplex mode comprising:

providing at least two printers joined by a parallel paper path device having at least two turning stations arranged in line with the at least two printers and symmetrically about a central axis, each turning station having at least one deflection bar perpendicular to a respective initial feed direction and rotationally supported, each turning station having an angled bar extending obliquely relative to the respective initial feed direction;

printing a first side of the recording medium in one of the at least two printers;

feeding the recording medium to one of the at least two turning stations over the at least one deflection bar corresponding to that one of the at least two turning stations in the respective initial feed direction;

feeding the recording medium further into the one of the at least two turning stations and over the corresponding angled bar to change the respective initial feed direction to a second feed direction;

feeding the recording medium further from that one of the at least two turning stations and into the other of the at least two turning stations in a respective initial feed direction;

feeding the recording medium further into the other of the at least two turning stations over the at least one deflection bar corresponding to the other of the at least two turning stations to change the direction of the recording medium from the respective initial feed direction to a respective second feed direction;

feeding the recording medium in the second respective feed direction to the other of the at least two printers;

printing on the second side of the recording medium; and feeding the recording medium in a third feed direction reverse that of the respective second feed direction to exit the printer and the parallel paper path device and enter a post processing device.

27. A method of transporting a recording medium in simplex mode comprising:

providing at least two printers joined by a parallel paper path device having at least two turning stations arranged symmetrically about a central axis, each turning station having at least one deflection bar perpendicular to a respective initial feed direction and rotationally supported, each turning station having an angled bar extending obliquely relative to the respective initial feed direction;

printing a first side of the recording medium in one of the printers;

feeding the recording medium to one of the at least two turning stations over the at least one deflection bar corresponding to that one of the at least two turning stations in the respective initial feed direction;

feeding the recording medium further into the one of the at least two turning stations and over the corresponding angled bar to change the respective initial feed direction to a second feed direction;

feeding the recording medium further from that one of the at least two turning stations and into the other of the at least two turning stations in a respective initial feed direction;

feeding the recording medium further into the other of the at least two turning stations over the at least one deflection bar corresponding to the other of the at least two turning stations to change the direction of the recording medium from the respective initial feed direction to a respective second feed direction reverse of the respective initial feed direction;

feeding the recording medium further into the other of the at least two turning stations and over the corresponding angle bar to change direction of the recording medium to a third feed direction; and feeding the recording medium in the third feed direction to exit the other of the at least two turning stations and the parallel paper path device and enter a post processing device.

* * * * *